United States Patent [19]

Brown

[11] Patent Number: 4,611,993

[45] Date of Patent: Sep. 16, 1986

[54] LASER PROJECTED LIVE FIRE EVASIVE TARGET SYSTEM

[75] Inventor: C. David Brown, Harve de Grace, Md.

[73] Assignee: The United States of America as represented by the Secretary of the Army, Washington, D.C.

[21] Appl. No.: 615,656

[22] Filed: May 31, 1984

[51] Int. Cl.[4] ..... F41G 3/26

[52] U.S. Cl. ..... 434/21; 273/403; 273/404; 273/371; 273/310

[58] Field of Search ..... 273/403, 404, 371, 310, 273/311, 312; 434/20, 22, 44

[56] References Cited

U.S. PATENT DOCUMENTS 4,175,748 11/1979 Yokoi ..... 273/310

FOREIGN PATENT DOCUMENTS 0018673 11/1980 European Pat. Off. ..... 273/371
2360094 6/1975 Fed. Rep. of Germany ..... 273/371
3002467 7/1981 Fed. Rep. of Germany ..... 273/371
3025161 1/1982 Fed. Rep. of Germany ..... 273/371

*Primary Examiner*—Leo P. Picard
*Attorney, Agent, or Firm*—Saul Elbaum; Alan J. Kennedy; Anthony T. Lane

[57] ABSTRACT

Apparatus for testing and evaluating live fire weapons systems. A vertical projection screen is located downrange from an operator controlled weapons system which launches an ordnance tracer projectile intended to intercept a target. The target is a bright laser spot projected and steered along the projection screen. The projection screen has a retroreflective surface and is constructed out of disposable panels. The projectile is detected as it approaches the laser spot target, and apparatus is provided for scoring the projectile within a specified area around the laser spot target.

9 Claims, 3 Drawing Figures

FIGURE I

LASER PROJECTED LIVE FIRE EVASIVE TARGET SYSTEM

RIGHTS OF THE GOVERNMENT

The invention described herein may be manufactured and used by or for the U.S. Government for government purposes without payment to me of any royalty thereon.

BACKGROUND OF THE INVENTION

Previously, testing of fire controlled systems has been with hard targets such as remote controlled vehicles for towed targets. These targets were maneuvered at a constant crossing speed and were tracked by the item under test. This testing was severly restricted by weather conditions, limited target motion, imprecision, great expense, and complete lack of controlled evasive maneuver. Because of these limitations, a Moving Target Simulator was developed to replace or augment field testing wherever practical. The simulated target is projected by a laser, and the resulting target maneuvering patterns are created by computer positioning of beam director mirrors. The projection screen is a large hemispherical dome with a target projector and test item positioned near center. The gunner in the weapon system under test tracks laser spot through various target maneuvers while data on the effectiveness of the fire control system is being gathered with the use of video processing systems.

The Moving Target Simulator has proven successful for several reasons. Extremely precise, repeatable target paths can be generated to test existing fire control systems. Also, new systems designed to defeat evasive countermeasures by enemy forces can quickly be evaluated and analyzed. Theoretical concepts of predictive fire control can be evaluated with this methodology. Since computer controlled real time data acquisition and near real time analysis is capable in the Moving Target Simulator, productivity increases are significant.

The Laser Projective Live Fire Evasive Target System extends the Moving Target Simulator concept to the firing range. A new tank range was required for developmental and production testing of the M1E1 tank, and this range required a moving target capability. All previous ranges used remotely controlled vehicles on railroad tracks, or RF grid systems. All of these methods required extensive site preparation and considerable cost, and none provided precisely controlled evasive maneuver capability. The basic principle of the Laser Projected Live Fire Evasive Target System is similar to the Moving Target Simulator, where a computer controlled laser beam projected on a screen provides a target to engage. However, the laser spot had to be visible to a test item and its operator or gunner after being projected down range in bright sunlight. Since the gunner fires the weapon and there is no physical target downrange, impact coordinates have to be measured in midair. This accomplished using a high power laser, tower mounted beam steerer, highly reflective projection screen, and a video scoring subsystem. This system, with capability of remote target generation and maneuvering along with remote scoring provides a capability to evaluate weapon performance against a highly maneuverable, precisely controlled target.

SUMMARY OF THE INVENTION

An apparatus for testing and evaluating live fire weapon systems is provided. The apparatus comprises means for projecting and steering a visible laser beam to a projection screen to produce a visible laser spot target. The projection screen is a vertical retroreflective surface constructed out of disposable panels. An operator controlled means is provided for allowing a weapon system to launch an ordnance tracer projectile intended to intercept the laser spot target. The apparatus includes means for detecting the projectile as it approaches the laser spot target and means for scoring the projectile within a specified area around the laser spot.

The laser beam is first directed through variable collimator means so that the size of the laser beam can be varied. A single axis servo drive which has a turning prism mounted on it is provided. Means are provided for directing the collimated beam through the turning prism. The turning prism directs the collimated laser beam to the projection screen. The single axis servo drive is steered by means such as a computer.

A video camera is mounted on the single axis servo drive and boresighted with the laser spot target. The video camera is gated at a predetermined rate by means driven by a video synchronization generator to produce a sequence of video images. The sequence of video images is recorded by a video recorder. An electro-optical sky screen sensor is positioned in the vicinity of the projection screen to detect when the projectile passes through the vertical plane defined by the projection screen. The first video image after the projectile passes the vertical plane is marked by an electronic marking means. The electronic marking means is activated by the signal from the sky screen sensor. An electronic counter is used to measure time between the signal from the sky screen sensor and the occurrence of the marked video image.

Means are also provided to determine the coordinates of the projectile with respect to the coordinates of the laser spot target over time. A trajectory curve is fitted to the time sequence of the coordinates, and the trajectory curve is sampled at the time the projectile passes the vertical plane defined by the projection screen to yield the impact coordinates.

The means for projecting and steering a visible laser spot target upon the vertical projection screen is mounted on a tower structure. The tower comprises an inner highly stiffened tower having a massive base, and an outer tower having its own separate base. The inner and outer towers are not in physical contact with each other. An apparatus for projecting and steering invisible laser spot are mounted on the inner tower. The outer tower is used to support a protective enclosure.

The target is a bright laser spot on a retroreflective disposable target screen, projected by a 4 watt argon ion laser 2,500 meters up range. The green target spot is visible in broad daylight, and is 0.5 meter in diameter. A precisely controlled beam steering system moves the target spot at angular speeds up to 200 milliradians per second in azimuth and accelerations up to 2,000 milliradians per second. The beam steering system is a precision angular servo system moving the target to computer commanded positions with 0.02 milliradian accuracy and rates with 0.2 milliradian per second accuracy.

Precise computer control allows unlimited target motion and exact replication for good statistical analysis. All of the inaccuracies and support requirements involved with a target vehicle are eliminated.

In a typical test scenario, the laser beam steering system and control cabinet is located in a bunker approximately 2,500 m distant from a target screen. The screen is more than 500 m long and is covered with a green retroreflective material which accents reflection of the green argon laser beam. The projected laser spot can be varied from 0.5 m to 1.0 m in diameter by use of a variable collimator. Input signals provided by a control computer move the beam in azimuth across the screen. The test vehicle can then fire rounds at the target.

OBJECTS OF THE INVENTION

It is an object of the invention to provide a live fire evasive target system for weapon system testing.

It is an object of this invention to provide a single dimensional simulation of a moving target by projection techniques which has the capability for the system under test to track, engage, and fire at the target at live ranges.

It is a further object of this invention to provide a system in which operational effectiveness afforded by the computer target maneuvering and computer remote scoring results in considerable test time and data reduction savings, which amounts to substantial test cost savings.

It is an object of this invention to provide a bright laser spot target projected and steered along a projection screen in a precisely controlled manner by a computer.

It is an object of this invention to detect the projectile as it approaches the laser spot target.

It is an object of this invention to score the projectile within a specified area around the laser spot target.

DESCRIPTION OF THE PREFERRED EMBODIMENT

Figure 1:
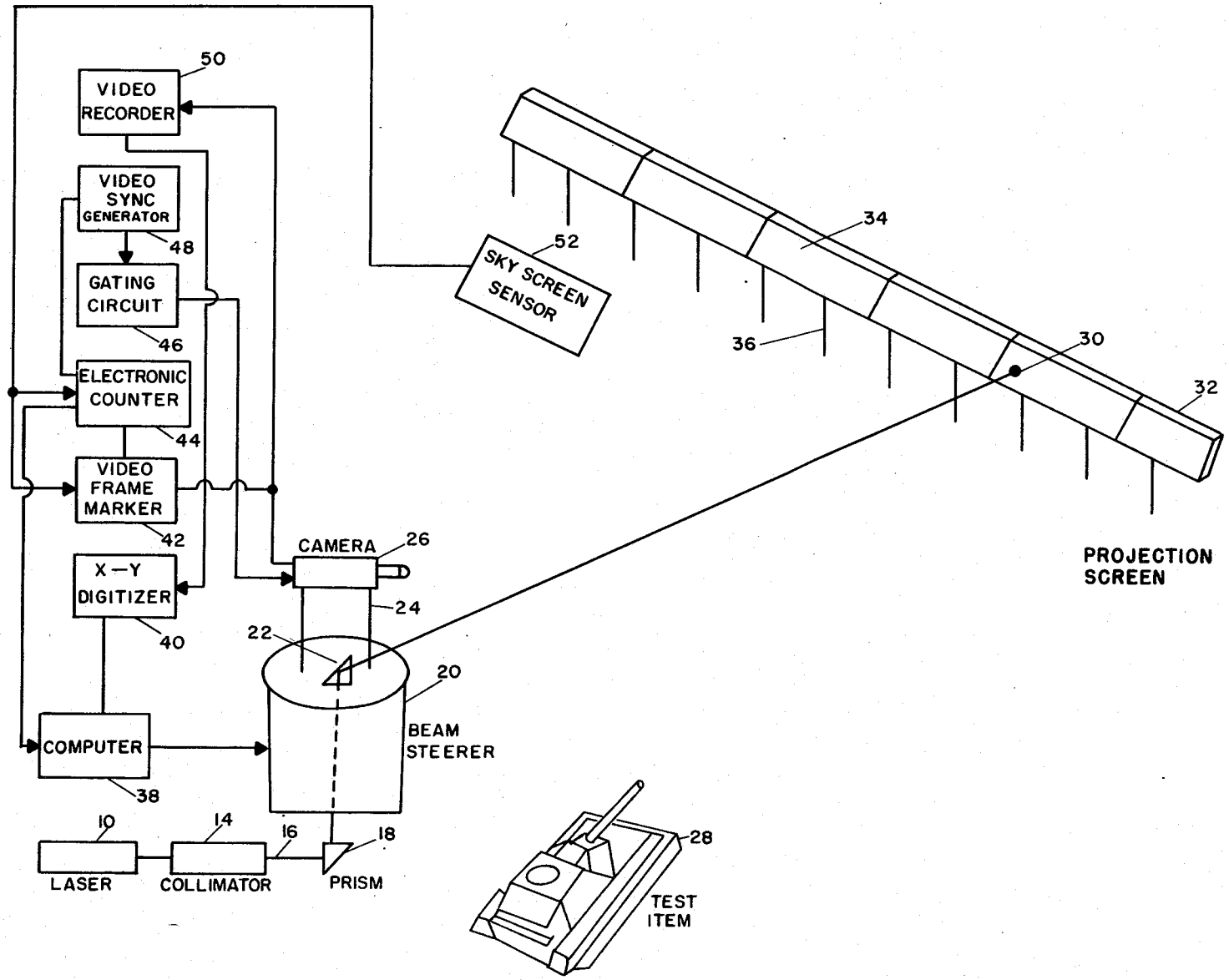
FIG. 1 is a schematic of the laser projected live fire evasive target system.

In FIG. 1 laser 10 generates a laser beam 12. Laser beam 12 is directed to variable collimator 14 for varying the size of the laser beam. The collimated beam 16 is directed to prism 18 which directs it up through beam steerer 20 to turning prism 22. Turning prism 22 directs collimated beam 16 to the projection screen 32. Laser beam 16 produces laser spot target 30 on the projection screen 32. Projection screen 32 is comprised of disposable plywood panels 34 supported on beams 36. Turning prism 22 is mounted on beam steerer 20. Beam steerer 20 comprises a single axis servo drive and it is used for changing the azimuth position of the turning prism. Beam steerer 20 is controlled by computer means 38.

Video camera 26 is mounted on beam steerer 20 by means of supports 24. The video camera 26 is boresighted with the visible laser spot target 30. Video synchronization generator 48 generates the sequence of synchronization pulses at a predetermined rate. The gating circuit 46, driven by the video synchronization generator 48, is used to gate video camera 26 to produce a sequence of video images. Video recorder 50 records the sequence of video images produced by a video camera 26. An electro-optical sky screen sensor 52, positioned in the vicinity of projection 32, senses when a tracer projectile, not illustrated, from test item 28, passes through the vertical plane defined by the vertical projection screen 32. The signal from the sky screen sensor 52 activates video frame marker 42, which then marks the first video image occurring after the projectile passes the vertical plane defined by projection screen 32. The marking signal from video frame marker 42 is electronically mixed into the video signal from video camera 26. An electronic counter 44 measures the elapsed time between the signal from the electro-optical sensor 52 and the occurrence of the marked video image.

An X-Y digitizer 40, connected to video recorder 50, is used to determine the coordinates of the projectile with respect to the coordinates of the laser spot target 30 over time. The digital computer 38, connected to X-Y digitizer 40, fits a trajectory curve to the time sequence of coordinates. The computer 38 also samples the trajectory curve at the time the projector passes the vertical plane defined by the projection screen 32 to yield the impact coordinates.

Figure 2:
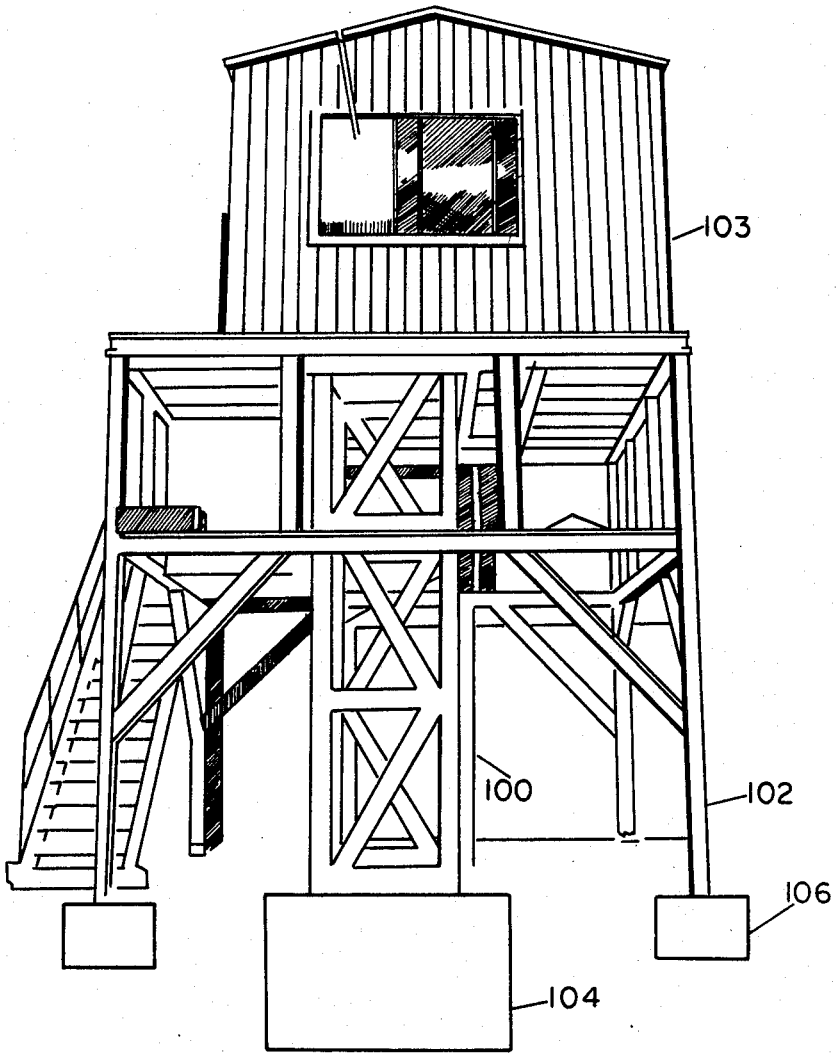
FIG. 2 is a schematic of the double tower arrangement.

The means for projecting and steering a visible laser spot target upon the vertical projection screen are mounted on a tower structure. The tower structure is illustrated in FIG. 2. It comprises an inner highly stiffened tower 100 having a massive base 104 to support the means for projecting and steering the visible laser spot target upon the vertical projection screen. An outer tower 102, having its own base 106 separate from that of base 104 of the inner tower is used to support a protective enclosure 103. The inner and outer towers are not in physical contact with each other. Mounted on the inner tower are laser 10, collimator 14, prism 18, and beam steerer 20.

Figure 3:
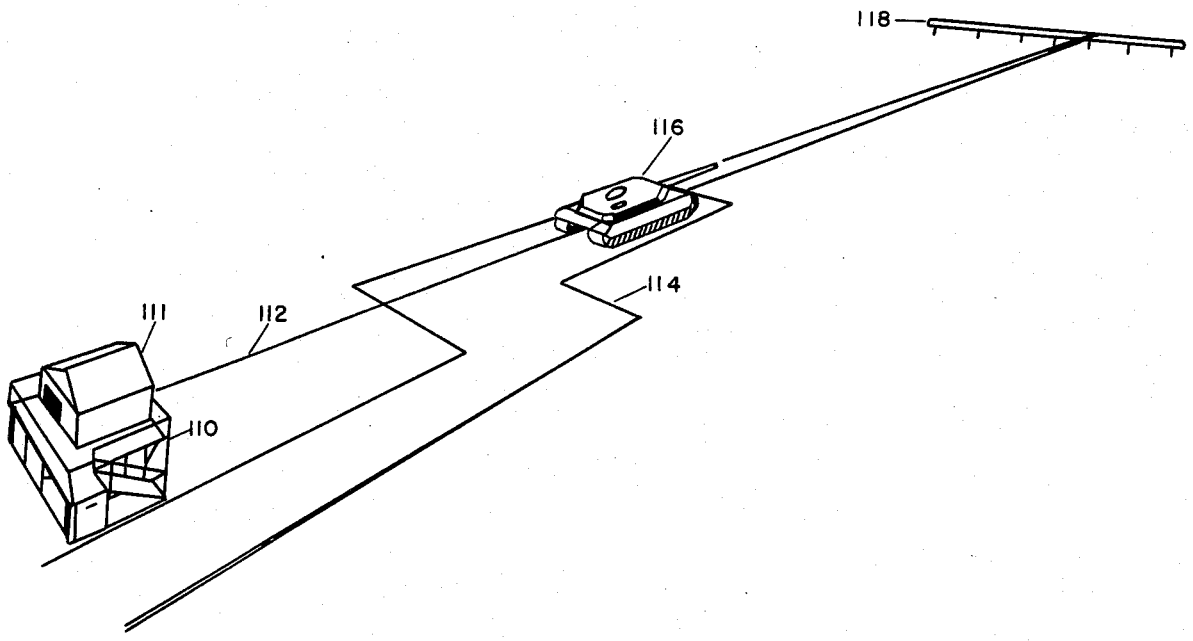
FIG. 3 shows the layout of the firing range.

FIG. 3 illustrates the layout of the firing range. Tower 110, with protective structure 111, are located at one end of the firing range. Laser beam 112 emanates from tower 110 and is directed to projection screen 118, located at the other end of the firing range. Test item 116, which travels along 114, is used to fire at projection screen 118.

The range layout depicted in FIG. 3 was dictated by geography and operational requirements. A 2500 meter range was required with the ability for the test item to close to within 500 meters of the target. Range safety restrictions dictated a firing fan amounting to 200 meters of crossing target motion, so a target projection screen width of 260 meters was chosen to allow 30 meters of lead-in motion on each side. An initial design proposed locating the laser projection subsystem centered 500 meters in front of the projection screen. This location was abandoned because: (1). it was difficult to properly protect the projection subsystem against possible projectile impact or sabot damage, (2). any structure could obscure a gunner's view of the target from further up range, and (3). the laser beam from the projection subsystem to the target screen would be very close to the ground and thus subjected to severe atmospheric turbulence effects. Therefore, the projection location was chosen directly behind the 2500 meter maximum range firing location, and located 2650 meters from the projection screen.

A nominal aim point target diameter of 0.5 meters was desired. Since the downrange screen needed only to reflect the laser back up range, a 0.5 meter high by 260 meter wide projection screen was mounted approximately 3 meters above ground level on poles. Thus, target motion is screen limited to azimuth direction only. Elevation motion capability was deemed impractical and nonessential.

The projection tower location shown in FIG. 2 was chosen for maximum retroreflectivity of the projection screen by aligning the projection and scoring subsystems lines of sight with that of the item under test. However, once the range was operational, live fire validation testing showed that the muzzle base and related debris from the weapon firing obscured the laser beam and video image soon enough and long enough so as to interfere with scoring in the center portion on the projection screen. For this reason, the tower has been moved to a position 100 meters behind and 30 meters to the right of the 2500 meter firing position.

The projected target in the preferred embodiment should be visible to the test item operator under various visibility conditions (as low as 3 kilometer visibility) and remain visible through sighting system optics as well as provide enough contrast for tracking within a video image. The factors affecting the solution to the problem are atmospheric absorption, scattering, turbulence, background illumination, projection screen reflectivity, and laser output power, as they affect both the spot and the video camera image contrast and motion.

Light beams propagating through the atmosphere are subject to such phenomena as molecular and aerosol absorption, molecular and aerosol scattering, and scattering from thermal fluctuations. These effects combine to reduce the apparent contrast of the scene by exp(−Sv*R) where Sv is the attenuation coefficient and R is the range. The inherent contrast ratio at the target is defined by:

$$Co=[La-Lb]/Lb$$

where La is the luminance of the object of interest including the background, and Lb is the luminance of the background. Setting the luminance of the object of interest, the laser spot, to L1, then the required laser power for a given contrast is:

$$L1=Co*Lb$$

The apparent contrast required for human vision is 2 percent. The extinction coefficient (Kext) for a 3 km. visibility is 1.304 per km., and the apparent contrast is given by exp(Kext*R)=0.038. Therefore, the required contrast for human vision with a 3 km. visibility is 0.02/0.038=0.526, or the irradiance within the laser spot area must be at least 1.526 times the irradiance elsewhere in the field of view.

In addition to the above effects, turbulence is found to be present. Atmospheric turbulence is the result of thermal fluctuations in the air along the propagation path. These fluctuations can cause the collimated laser beam to wander across the target, increase or decrease in size, or break up into small beamlets. Turbulence is most severe under light wind conditions and rapidly changing ground temperature. In general, when the atmosphere is thermally unstable, as on a clear summer day, turbulence induced image motion decreases with height, increase rapidly with change in temperature versus height and increases slowly with low wind speeds. This effect appears as a low frequency optical modulation of both the projected beam and reflected image.

Another turbulence induced effect is the spreading of the laser beam due to variations in the index of refraction over the path length. This effect can, in the case of severe turbulence, effectively double the apparent beam divergence over the 2500 range. Under these conditions the laser beam divergence will need to be set to around 0.1 milliradian through the use of a beam collimator.

Slower, more general thermal changes are responsible for an effect known as optical path bending. At certain times of the day, and under certain conditions, this effect can cause beam or image vertical deflection on the order of 1 milliradian. This can cause the laser spot to be above or below the projection screen. This deflection occurs slowly, such as over a 12 hour period, so it can be accommodated with manual elevation adjustments that are checked occasionally to keep the laser spot on the screen.

Another factor to consider is the background radiation seen by the sensor. It consists of the sky spectral radiance and the scattered reflection from the ground and vegetation. Sky background radiation in the visible region of the spectrum is caused by the molecular and aerosol scattering by the atmospheric constituents. Aerosol scattering also contributes to background illumination by scattering the laser energy back toward the laser source. The contrast ratio required for the video tracker or observer to see the target indicates that these backscatter values are small enough to be ignored.

The atmosphere will also attenuate the laser radiation by the expression: Er=Eo*exp(−Sv*R) where Er is the energy of the beam at distance R, Eo is the initial energy in the beam, and Sv is the atmospheric attenuation coefficient. Evaluation of the equation for the worst case conditions (3 km visibility) results in a bidirectional transmission (Er/Eo) of 0.15 percent.

Because of it's high retroreflectivity, 3M High Intensity Scotchlite was selected for the projection screen. The absolute reflectivity of this target material at the worst case incident angle (14.2 degrees) is 10.0 percent with a lambertian type radiation pattern peaked at the incident angle.

In addition to the human observer, the laser spot must also be contrast detectable in an image of an electronically gated vidicon camera with a 90 mm. aperture, 2800 mm. focal length lens. Analysis of the camera and optical system results in a nominal required image power level of 0.05 microwatts per cm. squared at the entrance to the optical system. Reliable electronic detection of the laser spot requires a video detected power level ratio between laser spot and surrounding background of 1.5. This ratio is comparable to the 1.526 calculated earlier for detection by the human observer. The required emitted laser power is 0.05 microwatts per cm. squared, multiplied by 1.5 detection ratio, multiplied by 7854 cm. squared in the 0.5 m radius spot, divided by 0.0015 bidirectional transmission ratio, divided by 0.10 screen reflectance, which equals 3.9 watts for effective system operation at typical worst case conditions.

The selected laser is commercially available 5 watt continuous wave argon with a beam divergence of 0.69 milliradian. The addition of a 8× beam collimator yields an acceptable beam divergence of 0.086 milliradian.

FIG. 1 shows the path of the laser projection beam to the center of rotation of the beam steerer, which azimuth positions the final beam turning prism, thus positioning the laser target spot on the projection screen. The beam steerer is a commercially available, high response, precision single axis servo drive mount with electronics to drive, monitor, and correct the position and rate.

The steerer is capable of driving the laser beam, and an optical payload such as the boresighted camera mounted above the turning prism, at angular velocities greater than 0.2 radians per second and accelerations greater than 2.0 radians per second squared. The drive electronics accept a 16 bit binary position or rate command from a digital computer and provide position readout back to the computer from a 1:128 resolver/inductosyn transducer with a resolution of 24.0 microradians.

Accuracy of the beam steering positioning is affected by: (1). servo system angular positioning accuracy, (2). servo system step response and bandwidth, (3). drive mount bearing wobble, and (4). tower instability.

The tower was specifically designed for maximum stability and is composed of two support structures. The outer structure supports the protective enclosure and control equipment, while an inner highly stiffened structure with a massive base supports the projection and beam steering subsystems. The structures have separate bases and no physical contact other than foam rubber insulation between them. The tower is required to raise the projection beam 20 feet above ground level for operational safety on the range and to minimize atmospheric turbulence effects. The tower is designed to minimize the vibration effects of wind and gun firing blast. The tower effectively eliminates any wind induced vibration, however, gun blast from a 120 mm. tank gun located at the 2500 meter firing position induces an 8 to 10 hertz resonant vibration of the inner tower with a peak to peak magnitude of about 60 microradians (about 15 cm. at the screen). Because this vibration is sinusoidal, the RMS positioning error due to tower instability is within 5 cm.

With the Laser Projected Live Fire Evasive Target System, the test item operator's aim point and engagement target is a moving laser spot on a projection screen. Therefore, conventional scoring methods are inadequate for obtaining miss distance data of a projectile relative to this target. Design considerations affecting the scoring subsystem were: (1). the subsystem had to score a projectile within a specified area around the laser spot, (2). RMS scoring accuracy desired was within one half the diameter of the projectile (6 cm. for the 120 mm. M1E1 tank ammunition), and (3). subsystem complexity had to be minimized to maximize reliability and operator efficiency.

Two concepts for projectile scoring were examined. One concept was an acoustic system which located the projectile in space by its shock wave arrival time at an array of microphones located on the ground beneath the projection screen. This system was abandoned because of complexity, difficulty of signal transmission back up range, and lack of hard copy, hard target, or other permanent record for later impact verification.

A second concept was a video scoring system utilizing a video camera mounted on the scanning portion of the laser beam steerer such that it is always boresighted with the laser target spot. The camera provides continuous observation of the target as well as the information for scoring the projectiles. The camera uses electronic gating to record a time sequence of images of the projectile as it passes the target. The electronic gating is accomplished by turning a microchannel plate image intensifier on for an extremely short length of time during each video field, thus allowing short duration video images to be produced. The short duration image allows the tracer of the round to appear as a well-defined spot, rather than a streak which is produced with the longer duration image of a non-gated video camera. The video field of view of the boresighted camera defines the scoring area of the imaginary target plane, which is the vertical plane defined by the vertical projection screen. The field of view, which is easily changed by changing the lens focal length, determines the scoring precision, and thus affects the scoring accuracy.

An electro-optical sensor (sky screen) at the projection screen detects the round as it passes through the imaginary target plane and sends a signal to the processing system. The signal is used simultaneously to mark the recorded video field immediately after impact and to start a counter which is stopped by a signal from the video synchronization generator. The time measured by the counter is used to establish a time relationship between the time when the round passes through the imaginary plane of the target and each of the video fields.

The video signal is recorded throughout the flight of the round by a wide bandwidth video tape recording system and can be played back one field at a time. The recorded video is input to an X-Y video digitizer to determine the coordinates of the round in successive video fields before and after the field of impact. A trajectory curve is fit to these time sequence coordinates, and this curve is then sampled at the time of target plane passage to yield the impact coordinates.

Since the major components of the video scoring system (sky screen, gated video camera, video recorder, video monitor, X-Y video digitizer, computer) are all commerically available, system complexity is minimized, and reliability and ease of operation are high. The continuous video recording provides a permanent record and offers hard copy and visual examination and vertification capability.

Several factors affect the accuracy of the video scoring system: (1). resolution of the optics and the video sensor, monitor, and X-Y digitizer, (2). linearity and geometric distortion of the optics, video sensor, and X-Y digitizer, (3). stability of the video sensor and optics, and (4). atmospheric effects. Since initial design of the Laser Projected Live Fire Evasive Target System was for tank testing, a 9 meter square target area at the projection screen was desired. The limiting resolution of the system is that of the video sensor with 300 lines across a 10 mm. square scan area, which amounts to 3 cm. at the screen. The resolution of the 90 mm. aperture, 2800 mm. focal length lens is 1.0 arc second or 1.3 cm. at the screen. The resolution of the monitor (600 lines) and the X-Y digitizer (512 counts vertical, 1024 counts horizontal) also exceed that of the video sensor.

The linearity and geometric distortion of the video sensor exceeds that of all other system components and amounts to 1.0 percent of field of view or 9 cm. at the screen. A multipoint calibration yielding a polynomial data conversion equation reduces this inaccuracy to 3 cm., with a quite reasonable 5 by 5 matrix of calibration points and a second order polynomial conversion. The calibration points are loacted at the screen so that complete system stationary inaccuracies are accounted for.

Instability of the video sensor and lens is caused primarily by motion of the tower and beam steerer in response to weapon firing shock and wind. There can also be an addtional motion of the video sensor and lens relative to the mounting plant on the beam steerer. The camera mount was specifically designed for stability and light weight. No motion has been detected of the individual optical components of the lens, the video sensor, or the overall camera and lens combination relative to the mounting plate during scanning or firing. Therefore, the magnitude of this error is the same as that discussed earlier, or about 15 cm. peak to peak sinusoidal, or within 5 cm. RMS.

The atmospheric effects have been previously discussed in detail and they primarily reduce observation resolution and induce noise. Scattering does reduce resolution over the 2640 meter observation distance, but under conditions during which this range would be in use, this effect is negligible in comparison to the resolution of the video sensor. Turbulence causes apparent image motion which is actually a low frequency noise source. Since the stop action images of the projectile are discrete samples of a high dynamic phenomena, long term averaging techniques cannot be utilized to minimize this error source. Theoretical calculations and field testing (conducted on site during normal range working times and excluding times of severe turbulence) using video tracking of a stationary light source show this effect to have atypical magnitude of 15 microradians RMS (4 cm. at the screen) and a frequency of 1 hertz. The image deflection cause by optical path bending changes slowly enough that this potential error source is eliminated by calibrating and boresighting the video camera at regular intervals (morning, noon, late afternoon) during the test day.

Considering all the above discussed error sources as independent, the combined effect amounts to a total system accuracy of 8 cm. (square root of the sum of the squares of the errors: 3, 1.3, 1.5, 1.8, 3, 5, and 4 cm.). Two of the error sources, the camera and lens stability and atmospheric turbulence, exhibit periodicity, so that fitting the trajectory curve to the time sequence video samples of the projectile images is effectively filtering over a period of typically 10 to 12 samples or 9.2 seconds. This filtering can remove a considerable amount of the error induced by the 8 to 10 hertz tower motion (image blur is still a problem) and some of the affect of atmospheric turbulence. This can reduce total scoring inaccuracy to within the desired 6 cm.

Numerous scoring validation tests were conducted once the Laser Projected Live Fire Evasive Target System was fully operational on the range at Aberdeen Proving Ground. Cloth and wire mesh screens were erected at the projection screen such that the fired projectiles impacted and put holes in the cloth or wire mesh. Projectiles were fired at the laser spot with its stationary and moving. In both cases, the projectile impacts were measured manually and with the video data validated the 6 cm. predicted scoring accuracy.

While the invention has been described to make reference to the accompanying drawings, I do not wish to be limited to the details shown therein as obvious modifications may be made by one of ordinary skill in the art.

I claim:

1. An apparatus for testing and evaluating live fire weapons systems comprising:

a. an operator controlled means for allowing a weapons system to launch an ordnance tracer projectile intended to intercept a target;

b. a vertical projection screen having a retroreflective surface located downrange from said weapons means;

c. means for projecting and steering a visible laser spot target upon said screen;

d. means for detecting said projectile as it approaches said laser spot target e. said detecting means includes a video camera mounted on said means for projecting and steering a visible laser spot target and boresighted with said laser target;

f. electro-optical sensor means for detecting when said projectile passes through the vertical plane defined by said projection screen;

g. means to mark the first video image after said projectile passes said vertical plane, said means being actuated by the signal from said electro-optical means; and h. means for scoring said projectile within a specified area around the laser spot target.

2. The apparatus of claim 1 wherein said means for projecting and steering a visible laser spot target upon said projection screen comprises:

a. means for generating a laser beam;

b. variable collimator means for varying the size of said laser beam;

c. a turning prism for directing the collimated laser beam to said projection screen;

d. means to direct the collimated laser beam through said turning prism;

e. a single axis servo drive for changing the azimuth position of said turning prism; and f. means for steering said single axis servo drive.

3. The apparatus of claim 1 wherein said means for detecting said projectile as it approaches said laser spot target comprises:

a. a video synchronization generator;

b. means to gate said video camera at a predetermined rate to produce a sequence of video images, said means driven by said video synchronization generator;

c. means for recording said sequence of video images;

d. electronic counter means for measuring the elapsed time between the signal from said electro-optical sensor means and the occurrence of said marked video image.

4. The apparatus of claim 1 wherein said means for scoring said projectile within a specified area around the laser spot target comprises:

a. means to determine the coordinates of the projectile with respect to the coordinates of the laser spot target over time;

b. means to fit a trajectory curve to the time sequence of coordinates; and c. means to sample the trajectory curve at the time the projectile passes the vertical plane defined by the projection screen to yield the impact coordinates.

5. The apparatus of claim 1 wherein said vertical projection screen is comprised of disposable panels.

6. The apparatus of claim 1 further comprising a tower structure on which is mounted said means for projecting and steering a visible laser spot target upon the vertical projection screen.

7. The apparatus of claim 6, wherein said tower structure comprises:

a. an inner highly stiffened tower having a massive base to support said means for projecting and steering a visible laser spot target upon the vertical projection screen;

b. an outer tower having its own base separate from that of the base of the inner tower to support a protective enclosure; and c. said inner and outer towers are not in physical contact with each other.

8. The apparatus of claim 1 wherein said means for projecting and steering a visible laser spot target upon said projection screen comprises:

a. means for generating a laser beam; and b. means for steering said laser beam along said projection screen.

9. An apparatus for testing and evaluating live fire weapons systems comprising:

a. an operator controlled means for allowing a weapons system to launch an ordnance tracer projectile intended to intercept a target;

b. a vertical projection screen having a retroreflective surface located downrange from said weapon means;

c. means for projecting and steering a visible laser spot target upon said vertical projection screen;

d. means for detecting said projectile as it approaches said laser spot target;

e. means for scoring said projectile within a specified area around the laser spot target;

f. a tower structure on which is mounted said means for projecting and steering a visible laser spot target upon said vertical projection screen; and g. said tower structure having an inner highly stiffened tower having a massive base to support said means for projecting and steering a visible laser spot target upon the vertical projection screen, an outer tower having its own base separate from that of the base of the inner tower to support a protective enclosure, and said inner and outer towers are not in physical contact with each other.

* * * * *